US007712653B2

(12) United States Patent
DeBusk et al.

(10) Patent No.: US 7,712,653 B2
(45) Date of Patent: May 11, 2010

(54) CARTON WITH DISPENSER HAVING ACCESS FEATURES

(75) Inventors: Patrick J. DeBusk, Canton, GA (US); Michael R. Schmal, Atlanta, GA (US); Graham Hand, Roswell, GA (US); Elaine Yokubat, Chesterfield, MO (US); Raymond R. Spivey, Sr., Mableton, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 766 days.

(21) Appl. No.: 11/237,377

(22) Filed: Sep. 28, 2005

(65) Prior Publication Data

US 2006/0065703 A1 Mar. 30, 2006

Related U.S. Application Data

(60) Provisional application No. 60/614,797, filed on Sep. 30, 2004, provisional application No. 60/614,862, filed on Sep. 29, 2004.

(51) Int. Cl.
*B65D 17/00* (2006.01)
*B65D 43/00* (2006.01)
*B65D 5/00* (2006.01)

(52) U.S. Cl. ..... 229/122; 229/240; 229/242; 229/160.2

(58) Field of Classification Search ..... 229/240, 229/230, 243, 924, 925, 926; 206/407, 139, 206/429, 430, 434, 435; 221/28, 304, 199
See application file for complete search history.

(56) References Cited

U.S. PATENT DOCUMENTS 1,925,102 A 9/1933 Levkoff
2,005,924 A 6/1935 Wilson
2,067,749 A 1/1937 Zimmerman et al.
2,115,673 A 4/1938 Stompe
2,299,027 A 10/1942 Novak
2,669,351 A 2/1954 Carson et al.
2,754,047 A 7/1956 Schmidt et al.
3,078,032 A 2/1963 Robinson et al.
3,128,010 A 4/1964 Forrer
3,133,634 A 5/1964 Bozdar
3,178,242 A * 4/1965 Ellis et al. ..... 312/45
3,228,582 A 1/1966 Osberg
3,263,861 A 8/1966 Carr
3,265,283 A 8/1966 Farquhar
3,300,115 A 1/1967 Schauer
3,332,594 A 7/1967 De Capua
3,346,167 A 10/1967 Schmidt
3,356,279 A 12/1967 Root
3,517,858 A 6/1970 Farquhar (Continued)

FOREIGN PATENT DOCUMENTS

CA 873185 A1 6/1971

(Continued)

*Primary Examiner*—Nathan J Newhouse
*Assistant Examiner*—Christopher Demeree
(74) *Attorney, Agent, or Firm*—Womble Carlyle Sandridge & Rice, PLLC

(57) ABSTRACT

A carton has a removeable dispenser that forms a dispenser opening that allows articles to be removed from the carton. The dispenser also has access flaps that create access openings that provide access to articles in the carton.

27 Claims, 16 Drawing Sheets

U.S. PATENT DOCUMENTS 3,533,549 A 10/1970 Gilchrist
3,540,581 A 11/1970 Koolnis
3,894,681 A * 7/1975 Ameson et al. ..... 221/305
3,933,303 A * 1/1976 Kirby, Jr. ..... 229/117.13
4,155,449 A 5/1979 Bryne
4,214,660 A 7/1980 Hunt, Jr.
4,222,485 A 9/1980 Focke
4,256,226 A 3/1981 Stone
4,318,474 A 3/1982 Hasegawa
4,364,509 A 12/1982 Holley, Jr. et al.
4,375,258 A 3/1983 Crayne et al.
4,376,509 A 3/1983 Schaffer
4,378,877 A 4/1983 Botterman et al.
4,396,143 A 8/1983 Killy
4,417,655 A 11/1983 Forbes, Jr.
4,417,661 A 11/1983 Roccaforte
4,577,762 A 3/1986 Kuchenbecker
4,605,128 A 8/1986 Rieke
4,658,984 A 4/1987 Brunner
4,817,866 A 4/1989 Wonnacott
4,890,440 A 1/1990 Romagnoli
4,949,845 A 8/1990 Dixon
4,974,771 A 12/1990 Lavery
5,101,642 A 4/1992 Alexandrov
5,137,211 A 8/1992 Summer et al.
5,219,229 A 6/1993 Sengewald
5,249,681 A 10/1993 Miller
5,368,194 A * 11/1994 Oliff et al. ..... 221/305
5,425,474 A 6/1995 Dalea et al.
5,482,185 A 1/1996 McNaughton
5,505,372 A 4/1996 Edson et al.
5,577,612 A 11/1996 Chesson et al.
5,597,114 A 1/1997 Kramedjian et al.
5,622,309 A 4/1997 Matsuda et al.
5,664,683 A 9/1997 Brody
5,690,213 A 11/1997 Matsumura
5,690,230 A 11/1997 Griffith
5,794,778 A 8/1998 Harris
5,826,783 A 10/1998 Stout
5,875,961 A 3/1999 Stone et al.
5,881,884 A 3/1999 Podosek
5,921,398 A 7/1999 Carroll
5,924,559 A 7/1999 Carrel et al.
5,927,498 A 7/1999 Saam
6,050,402 A 4/2000 Walter
6,176,419 B1 1/2001 Holley, Jr.
6,283,293 B1 9/2001 Lingamfelter
6,409,077 B1 6/2002 Telesca et al.
D459,927 S 7/2002 Flowers et al.
6,478,219 B1 11/2002 Holley, Jr.
6,484,903 B2 11/2002 Spivey et al.
6,550,615 B2 4/2003 Lingamfelter
6,557,699 B1 5/2003 Focke et al.
6,578,736 B2 6/2003 Spivey
6,604,677 B1 8/2003 Sutherland et al.
6,669,083 B2 12/2003 Bates
6,715,639 B2 4/2004 Spivey
6,752,262 B1 6/2004 Boriani et al.
6,789,673 B2 9/2004 Lingamfelter
6,866,185 B2 3/2005 Harrelson
6,866,186 B2 3/2005 Fogle et al.
6,866,188 B2 3/2005 Harrelson
6,896,130 B2 5/2005 Theelen
6,902,104 B2 * 6/2005 Holley et al. ..... 229/242
6,918,487 B2 7/2005 Harrelson
6,929,172 B2 8/2005 Bates et al.
6,945,450 B2 9/2005 Rusnock
6,968,992 B2 11/2005 Schuster
6,969,172 B2 11/2005 Actis-Datta
6,974,072 B2 12/2005 Harrelson
6,991,107 B2 1/2006 Harrelson
6,997,316 B2 2/2006 Sutherland
7,000,803 B2 2/2006 Miller
7,059,494 B2 6/2006 Harrelson et al.
7,073,665 B2 7/2006 Auclair et al.
7,104,435 B2 9/2006 Holley, Jr.
7,134,593 B2 11/2006 Harrelson
7,225,930 B2 6/2007 Ford et al.
7,237,674 B2 7/2007 Auclair
7,328,798 B2 2/2008 Auclair et al.
2002/0029991 A1 3/2002 Lingamfelter
2002/0070139 A1 6/2002 Bates
2002/0088820 A1 7/2002 Spivey
2002/0088821 A1 7/2002 Spivey et al.
2003/0141313 A1 7/2003 Bates
2003/0150759 A1 8/2003 White, Jr.
2003/0192907 A1 10/2003 Bates
2004/0040334 A1 3/2004 Rusnock
2004/0089671 A1 5/2004 Miller
2004/0099558 A1 5/2004 Oliff et al.
2004/0188508 A1 9/2004 Holley, Jr. et al.
2005/0023170 A1 2/2005 Lingamfelter
2005/0092820 A1 5/2005 Chekroune
2005/0115843 A1 6/2005 Harrelson
2005/0167291 A1 8/2005 Sutherland
2005/0189405 A1 9/2005 Gomes et al.
2006/0054522 A1 3/2006 Kline et al.
2006/0091193 A1 5/2006 DeBusk
2006/0118606 A1 6/2006 Holley, Jr. et al.
2006/0131370 A1 6/2006 Bates
2006/0175386 A1 8/2006 Holley, Jr.

FOREIGN PATENT DOCUMENTS

EP 0 066 029 A1 12/1992
FR 2 549 010 1/1985
GB 2 264 101 A 8/1993
GB 0202809 2/2002
WO WO 96/29260 9/1996
WO WO 99/64301 12/1999
WO WO 00/03937 1/2000
WO WO 02/47990 A2 6/2002
WO WO 2004/043790 A2 5/2004
WO WO 2005/051781 A1 6/2005
WO WO 2006/050210 A2 5/2006
WO WO 2006/050316 A1 5/2006

* cited by examiner

CARTON WITH DISPENSER HAVING ACCESS FEATURES

RELATED APPLICATIONS

This application claims the benefit of both U.S. Provisional Application No. 60/614,862, filed Sep. 29, 2004, and U.S. Provisional Application No. 60/614,797, filed Sep. 30, 2004, the entire contents of both applications being hereby incorporated by reference.

BACKGROUND

Enclosed cartons with dispensing features have been used in the past. Many of these cartons include a dispenser defined by tear lines. The dispenser is removable from the carton to create an opening through which articles can be removed from the carton. In many instances, after the user engages and opens the dispenser, some of the articles, especially those disposed in a lower column or layer, are positioned substantially, or entirely, below the edge of the dispenser opening. In order to dispense the cans or articles that are substantially or entirely disposed below the dispenser opening, a user must insert their finger or other object into the carton in order to remove the can from the carton.

SUMMARY

The present invention generally relates to a carton with a dispenser that forms an opening to dispense articles from the carton. In accordance with an embodiment of the invention, the dispenser includes an additional access feature in the form of one or more access flaps that create access openings in the side panels of the carton. An access flap can be formed in only one side panel of the carton, or multiple access flaps can be formed in multiple panels of the carton.

The access flaps may be formed by lines of disruption such as tear lines, cuts, scores, etc. in the blank and may provide access to the articles in the carton. The access flaps may also be formed to minimize weakening of the panel or panels in which the access flaps are disposed. For example, the access flaps may be smaller than a characteristic dimension of articles held within the carton, such as the diameter of a can or other container, while being large enough to allow access to the articles.

Those skilled in the art will appreciate the above stated advantages and other advantages and benefits of various additional embodiments reading the following detailed description of the embodiments with reference to the below-listed drawing figures. According to common practice, the various features of the drawings discussed below are not necessarily drawn to scale. Dimensions of various features and elements in the drawings may be expanded or reduced to more clearly illustrate the embodiments of the invention.

DETAILED DESCRIPTION

The present invention generally relates to a dispenser for a carton. The present invention can be used, for example, in cartons that contain articles or other products such as, for example, food and beverages. The articles can also include beverage containers such as, for example, cans, bottles, PET containers, or other containers such as those used in packaging foodstuffs. For the purposes of illustration and not for the purpose of limiting the scope of the invention, the following detailed description describes generally cylindrical beverage containers as disposed within the carton embodiments. In this specification, the terms "lower," "bottom," "upper" and "top" indicate orientations determined in relation to fully erected cartons.

Figure 1:
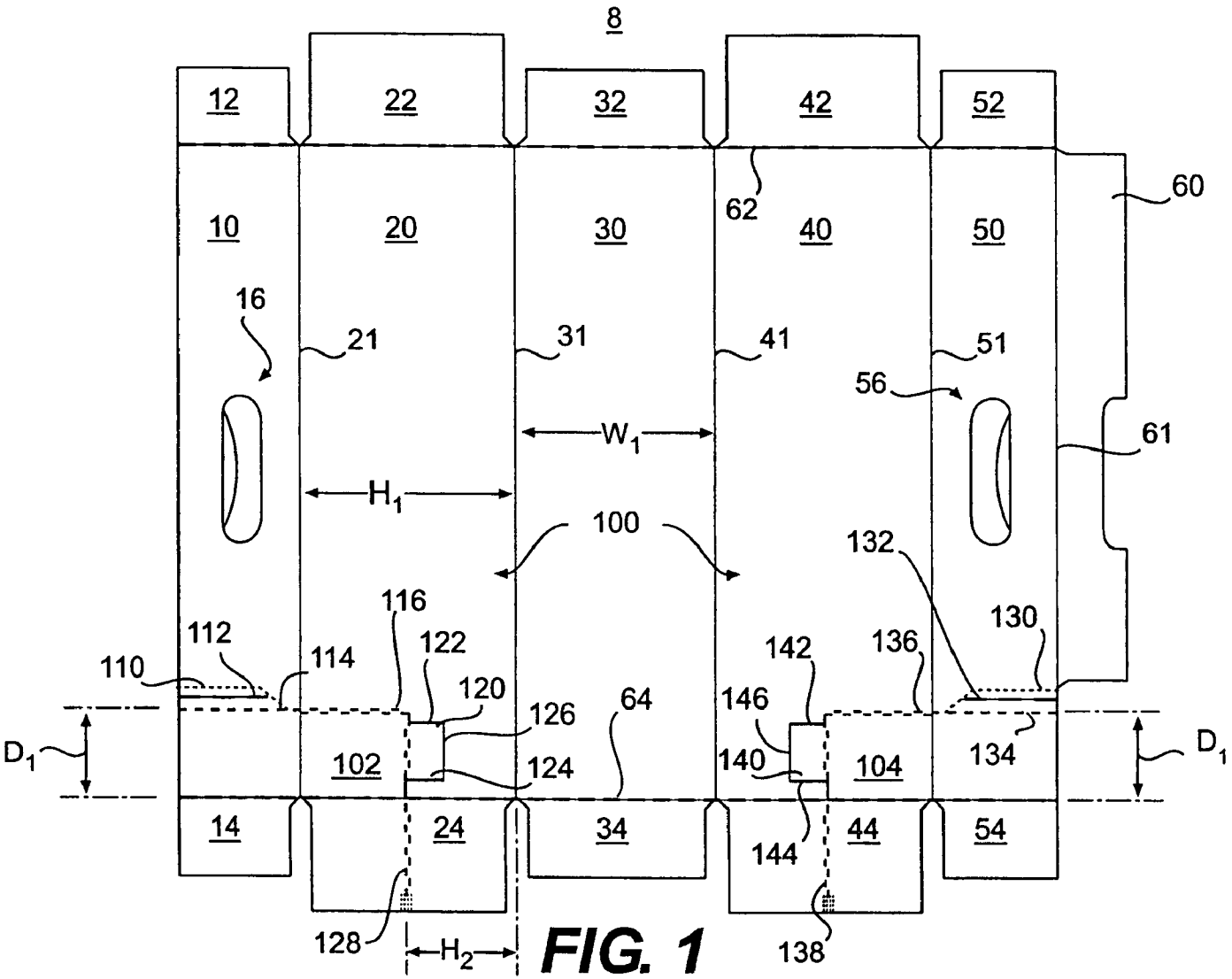
FIG. 1 is a plan view of a blank used to form a carton having a dispenser according to a first embodiment of the invention.

FIG. 1 is a plan view of a blank 8 used to form a carton 200 (illustrated in FIGS. 3A and 3B) according to a first embodiment of the invention. The blank 8 comprises a first top flap or panel 10 foldably connected to a first side panel 20 at a first fold line 21, a bottom panel 30 connected to the first side panel 20 at a second transverse fold line 31, a second side panel 40 foldably connected to the bottom panel 30 at a third transverse fold line 41, and a second top flap or panel 50 foldably connected to the second side panel 40 at a fourth transverse fold line 51. An adhesive flap 60 can be foldably connected to the second top flap 50 at a fifth transverse fold line 61.

The first top panel 10 is foldably connected to a first top end flap 12 and a first top exiting end flap 14. The first side panel 20 is foldably connected to a first side flap 22 and a first side exiting end flap 24. The bottom panel 30 is foldably connected to a bottom end flap 32 and a bottom exiting end flap 34. The second side panel 40 is foldably connected to a second side end flap 42 and a second side exiting end flap 44. The second top panel 50 is foldably connected to a second top end flap 52 and a second top exiting end flap 54.

When the carton 200 is erected, the end flaps 12, 22, 32, 42, 52 close one end of the carton 200, and the exiting end flaps 14, 24, 34, 44, 54 close an exiting end of the carton 200. The end flaps 12, 22, 32, 42, 52 extend along a first marginal area of the blank 8, and may be foldably connected at a first longitudinally extending fold line 62 that extends along the length of the blank 8. The exiting end flaps 14, 24, 34, 44, 54 extend along a second marginal area of the blank 8, and may be foldably connected at a second longitudinally extending fold line 64 that extends along the length of the blank 8. The longitudinally extending fold lines 62, 64 may be substantially straight and parallel to one another. The fold lines 62, 64 may also be offset at one or more locations to account for blank thickness or for other factors, for example. The blank 8 may include first and second handle apertures 16, 56 in the first and second top flaps 10, 50, respectively.

Figure 3A:
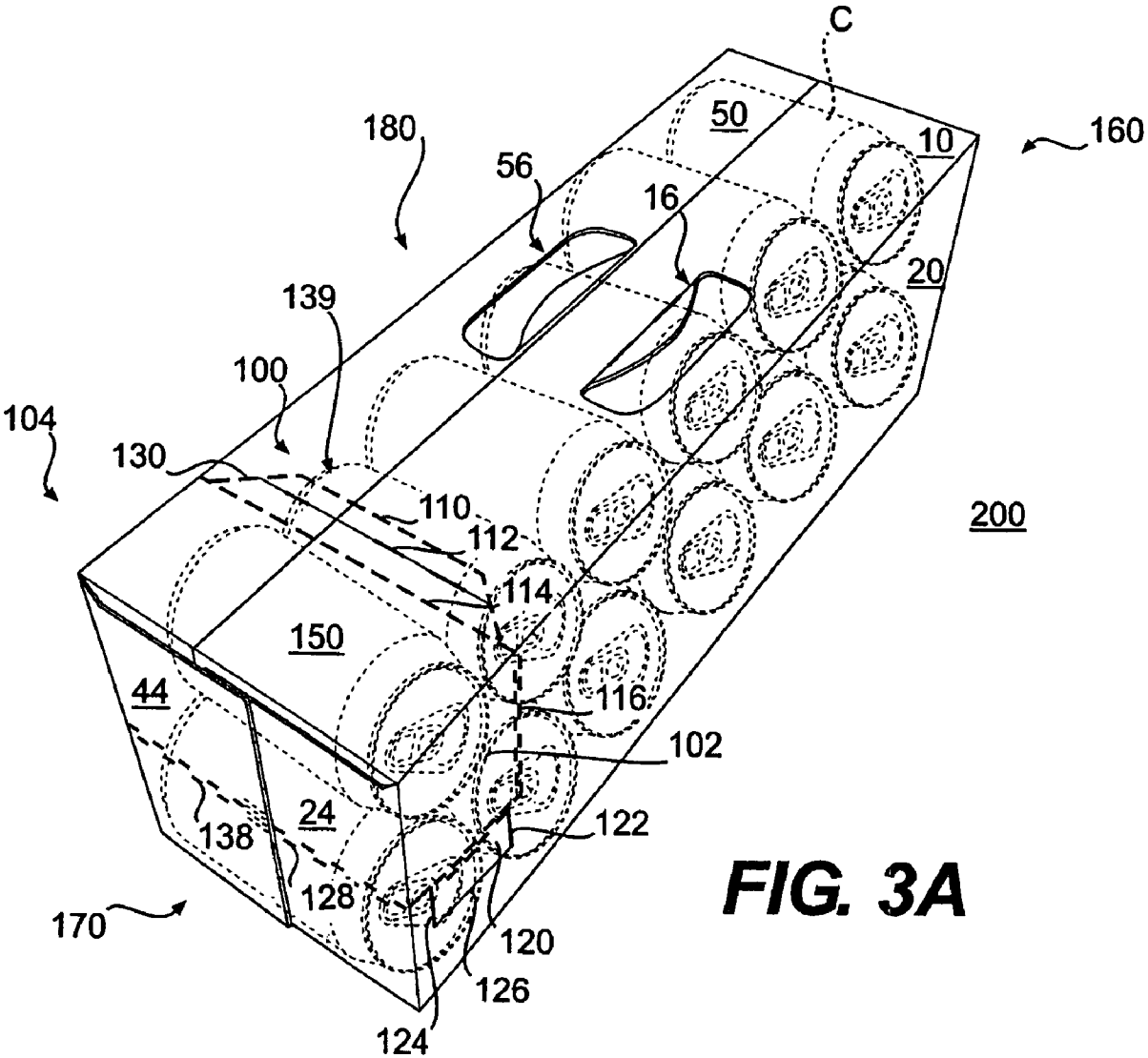
FIG. 3A is another perspective view of the erected carton according to the first embodiment.
Figure 3B:
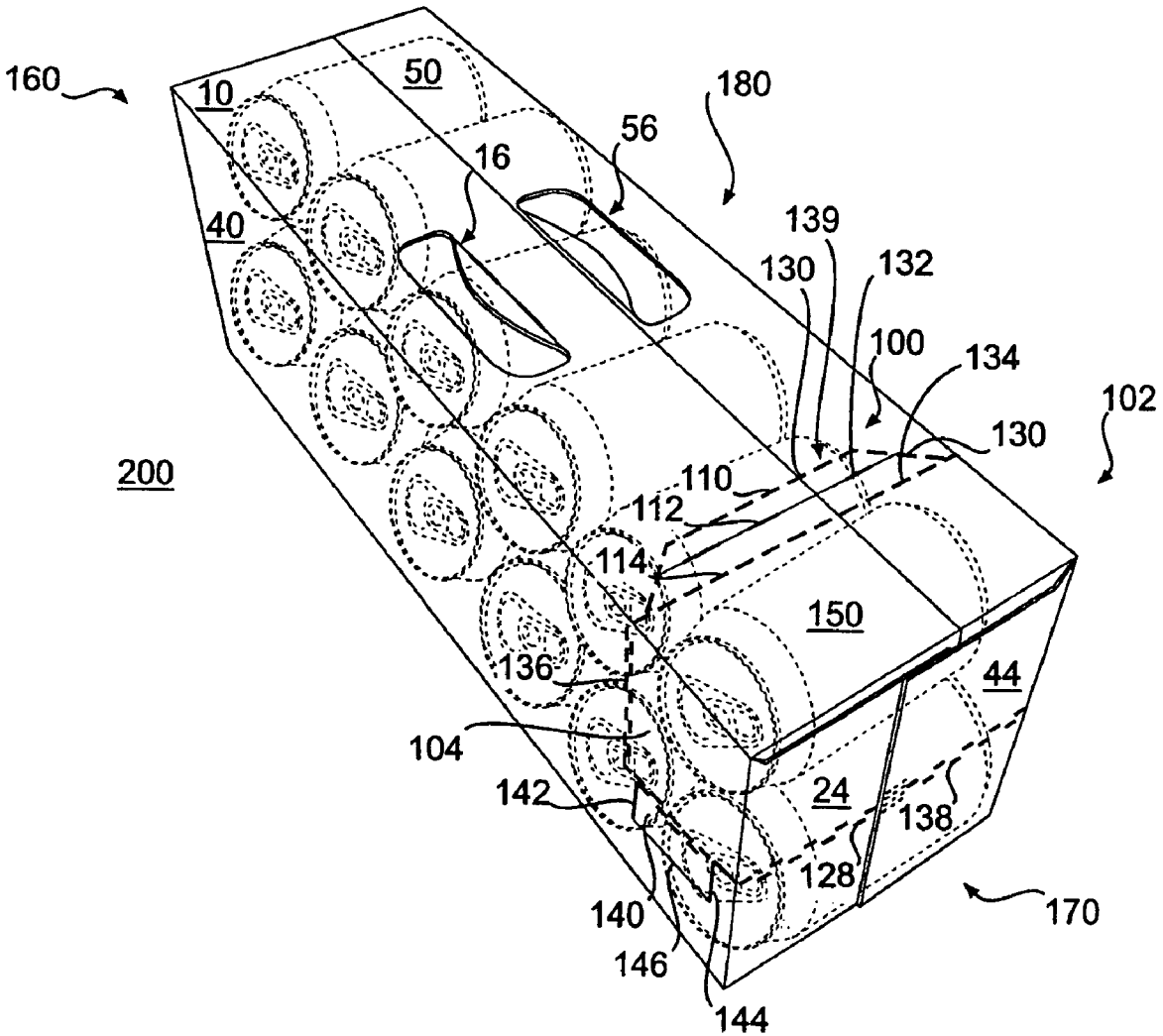
FIG. 3B is a perspective view of the erected carton according to the first embodiment.

The blank 8 includes a dispenser pattern 100 that defines a dispenser 150 in the erected carton 200 (FIGS. 3A and 3B). The dispenser pattern 100 comprises first through sixth opening lines 110, 112, 114, 130, 132, 134 in the top panels 10, 50, first and second generally downwardly or longitudinally extending lines 116, 136 that extend generally along the length of the blank 8, and first and second generally laterally or horizontally extending lines 128, 138 that extend generally along a width of the blank 8. The lines 116, 128 and the fold lines 21, 64 define a first side dispenser panel 102 in the first side panel 20, and the lines 136, 138 and the fold lines 51, 64 define a second side dispenser panel 104 in the second side panel 40.

The dispenser pattern 100 also includes a first access flap 120 defined by first, second and third access lines 122, 124, 126 and the laterally extending line 128, and a second access flap 140 defined by fourth, fifth and sixth access lines 142, 144, 146 and the laterally extending line 138. The first access flap 120 extends from a bottom portion of the first side dispenser panel 102, and the second access flap 140 extends from a bottom portion of the second side dispenser panel 104. In accordance with the first embodiment of the invention, the first and second access flaps 120, 140 are designed to be folded or pivoted or otherwise moved away from the side panels 20, 40 in order to provide access to containers C disposed in the carton 200.

The access lines 122, 124, 142, 144 may be, for example, cuts or tear lines formed from a series of cuts and/or scores. The lines 126, 146 may be, for example, fold lines formed from creases, cuts, and/or scores. The lines 116, 136 may be, for example, tear lines formed from offset cut/space lines. The lines 128, 138 may be tear lines formed from offset cut/space lines along a majority of their lengths. The lines 128, 138 define upper boundaries of the access flaps 120, 140, respectively, and may also include, for example, portions formed by cuts or scores and combinations thereof in order to facilitate opening of the dispenser 150.

The opening lines 110, 112, 114, 130, 132, 134 in the top flaps 10, 50 are adjacent to one another in the erected carton 200 and define an opening pattern 139 (FIG. 3A). The opening lines 110, 114, 130, 134 may be, for example, cut/space lines, and the lines 112, 132 may be cut/crease lines. Other lines of disruption may be used to form the lines of the dispenser pattern 100 so that the dispenser 150 operates in accordance with the principles of the present invention.

Figure 2:
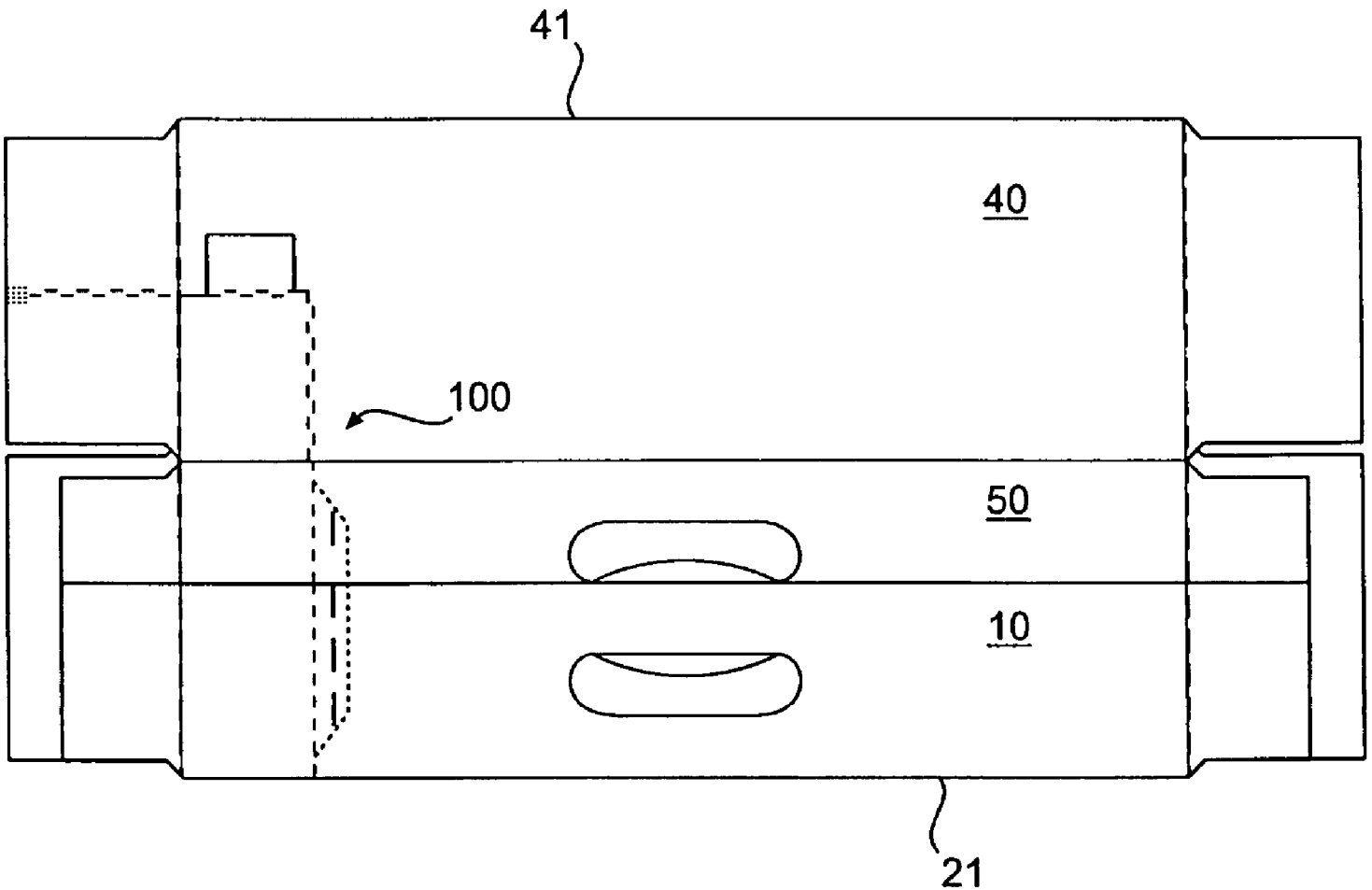
FIG. 2 illustrates a partially erected carton according to the first embodiment.

FIG. 2 is a perspective view of an erection step in which the carton 200 is partially erected. The carton 200 may be erected by gluing or otherwise adhering the adhesive flap 60 (shown in FIG. 1) to the underside of the first top flap 10 so that the flaps 10, 50 and the panels 20, 30, 40 may be opened to form a generally tubular sleeve. The ends of the tubular sleeve may then be closed by folding and gluing or otherwise adhering the end flaps 12, 22, 32, 42, 52 and the exiting end flaps 14, 24, 34, 44, 54. Articles such as, for example, generally cylindrical containers C may be loaded into the tubular sleeve in a conventional manner before one or both ends of the carton are closed by the end flaps.

In FIG. 2, the carton 200 is erected by adhering the top panels 10, 50 using the adhesive flap 60. This configuration is merely exemplary, however, and the tubular structure of the carton 200 can be obtained by joining ends of a blank at other panels, such as at the side or bottom panels.

FIGS. 3A and 3B illustrate the erected carton 200 loaded with containers C (indicated by hidden lines) stacked therein. In the first embodiment, the carton 200 encloses twelve 12 ounce can containers C. The containers C are arranged in the carton 200 in a two column and six row (2×6) configuration. In the erected carton 200, the end flaps 12, 22, 32, 42, 52 form a first end panel 160, the exiting end flaps 14, 24, 34, 44, 54 form a second, exiting end panel 170, and the top panels 10, 50 form a top panel 180. The dispenser 150 extends across the first and second side panels 10, 20, the top panel 180, and the exiting end panel 170. The opening lines 110, 112, 124, 130, 132, 134 may be generally aligned in the top panel 180 to define the opening pattern 139. Opening of the dispenser 150 is discussed below with reference to FIGS. 4-9.

Figure 4:
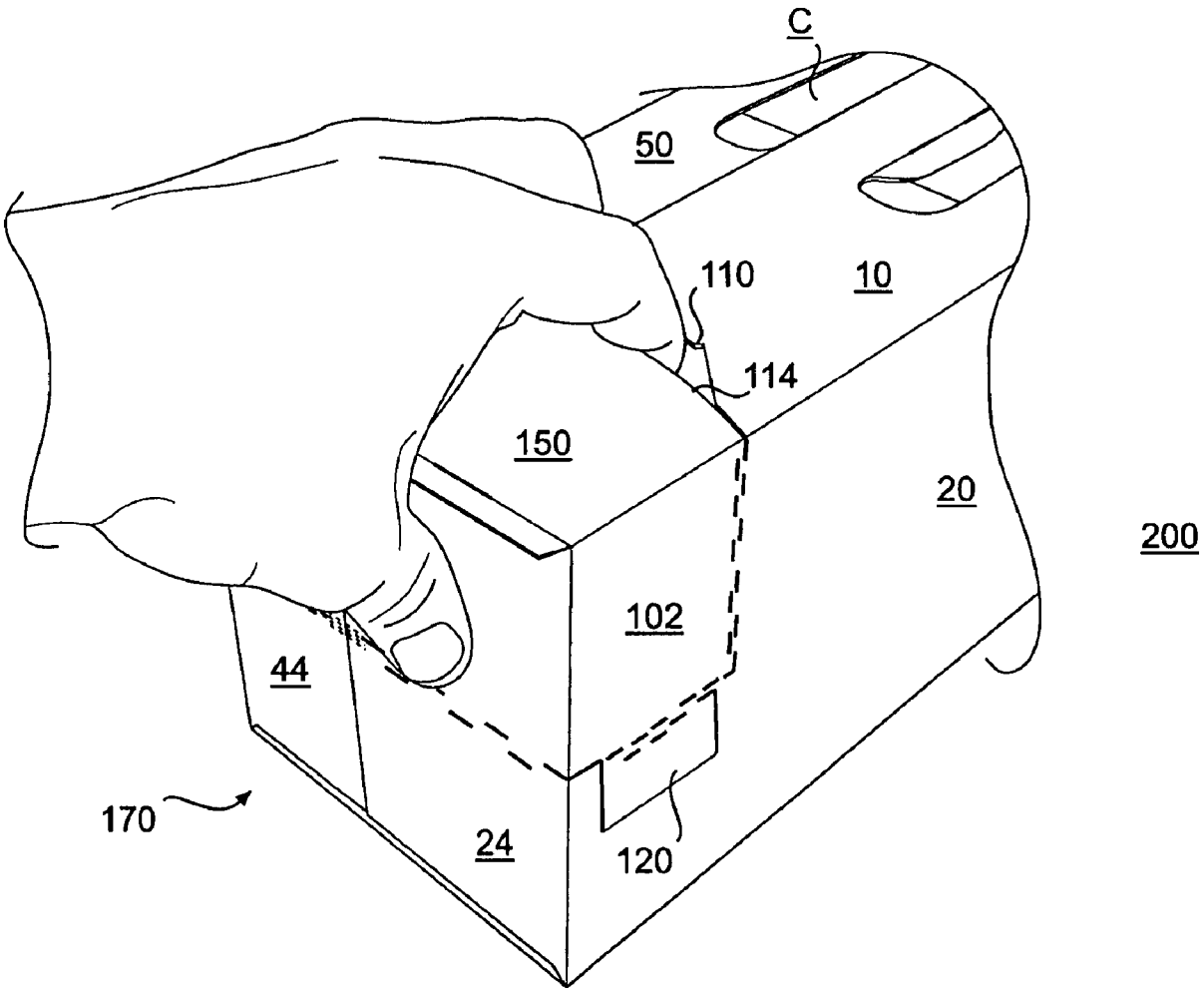
FIGS. 4-9 illustrate opening of the carton dispenser according to the first embodiment.
Figure 5:
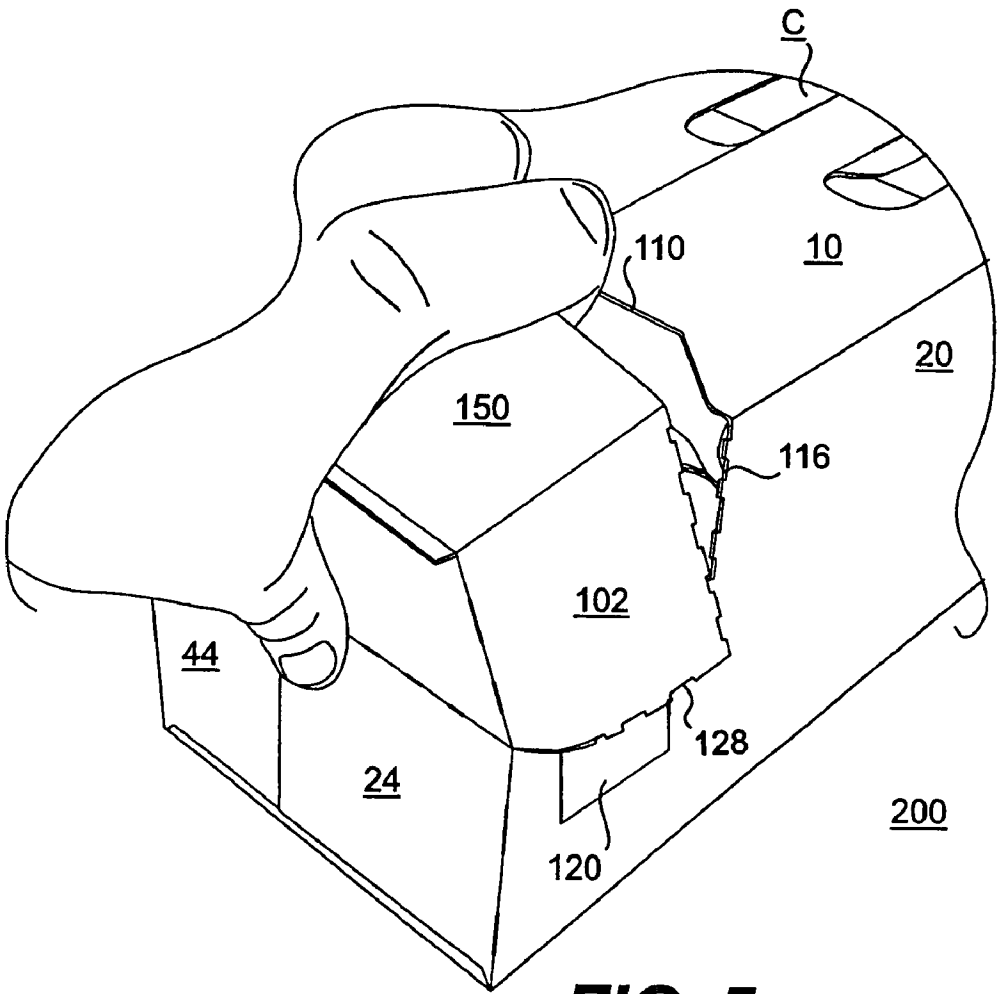
Figure 6:
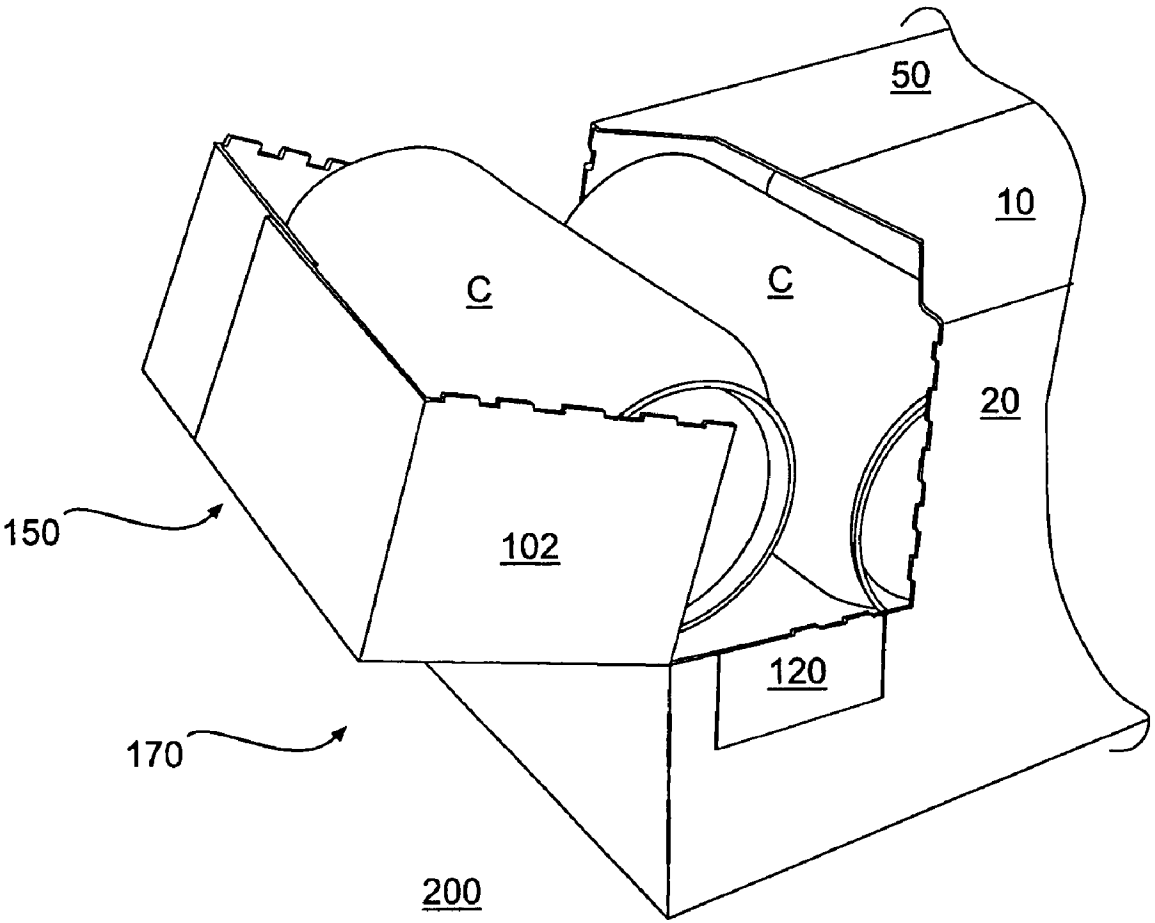
Figure 7:
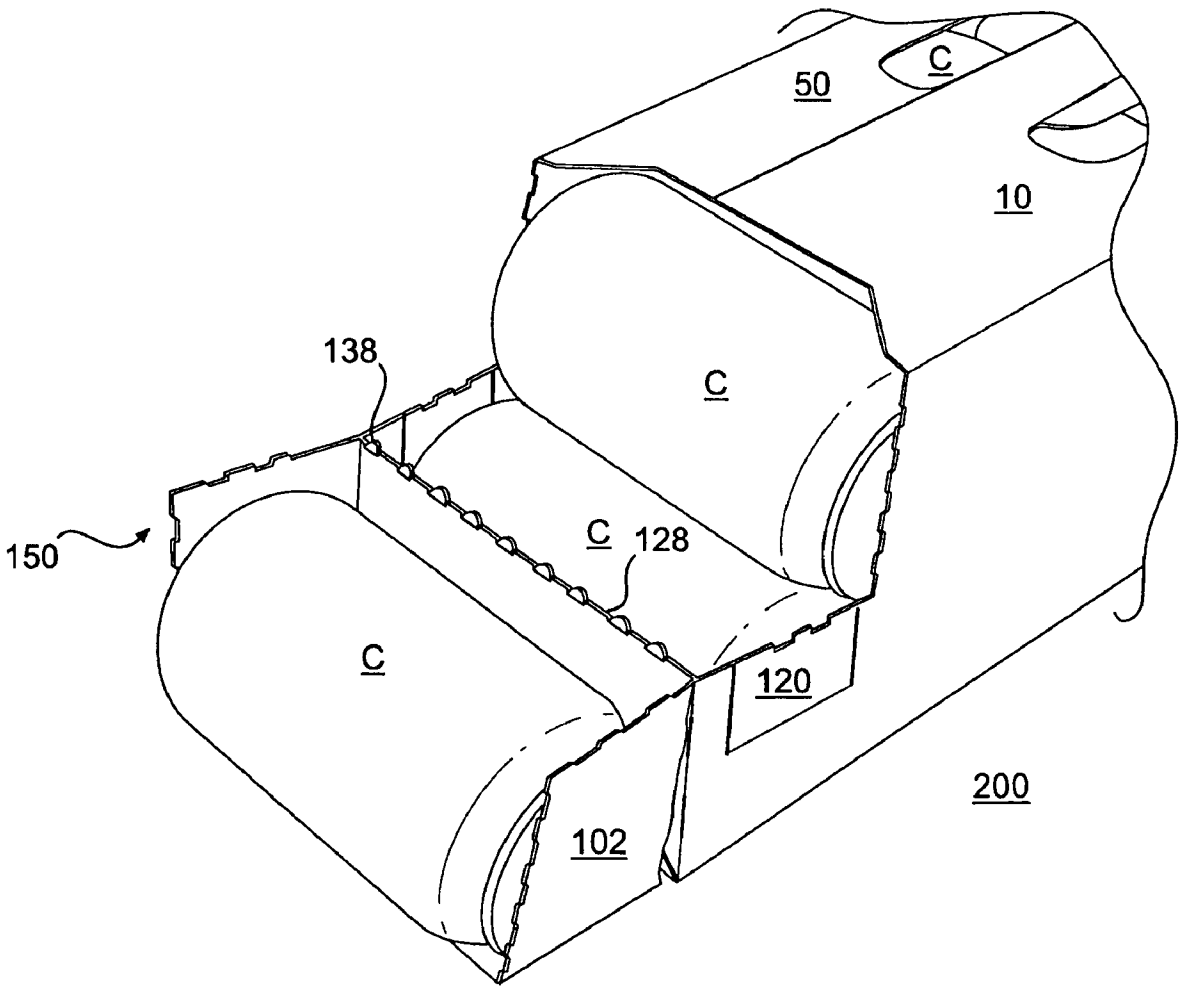

FIG. 4 is a perspective view of the dispenser 150 being opened. Opening may be initiated by pressing downwardly on the top panel 180 generally at the area defined by the opening pattern 139 so that the top panel 180 tears along the opening line 110. Referring to FIG. 5, the dispenser 150 is further opened by tearing along the lines 116, 136. Referring to FIGS. 6 and 7, the dispenser 150 may then be pivoted open at the lines 128, 138 to expose the carton contents. The flap defined by the opening pattern 139 can be, for example, folded into the dispenser 150 or the carton 200, or removed during opening of the dispenser 150. If containers C are stacked in the carton 200, a container C adjacent to the dispenser 150 may be, for example, carried out of the carton 200 as the dispenser 150 is pivoted open. According to the first embodiment, the access flaps 120, 140 remain attached to the carton 200 upon opening of the dispenser 150.

Figure 8:
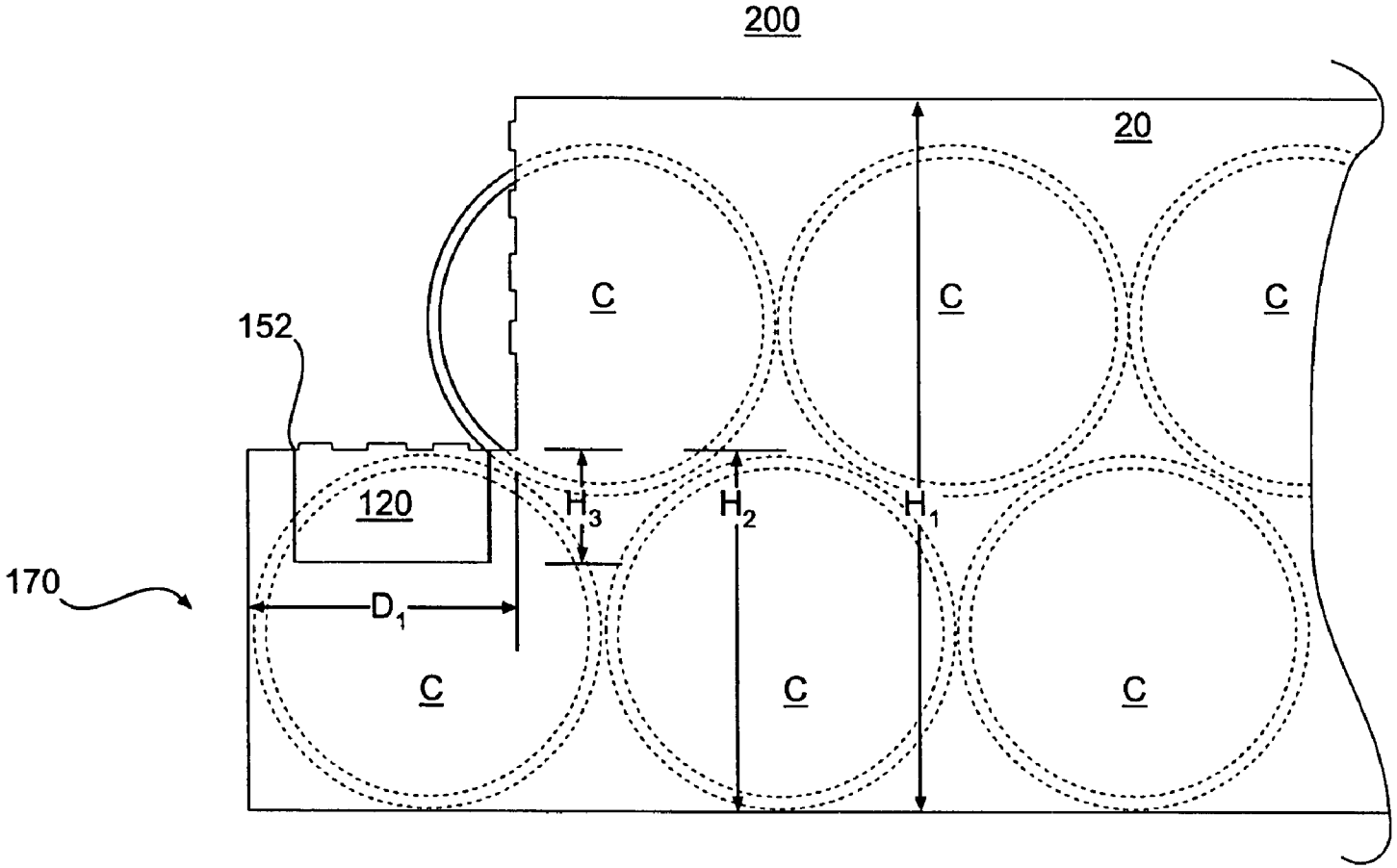
Figure 9:
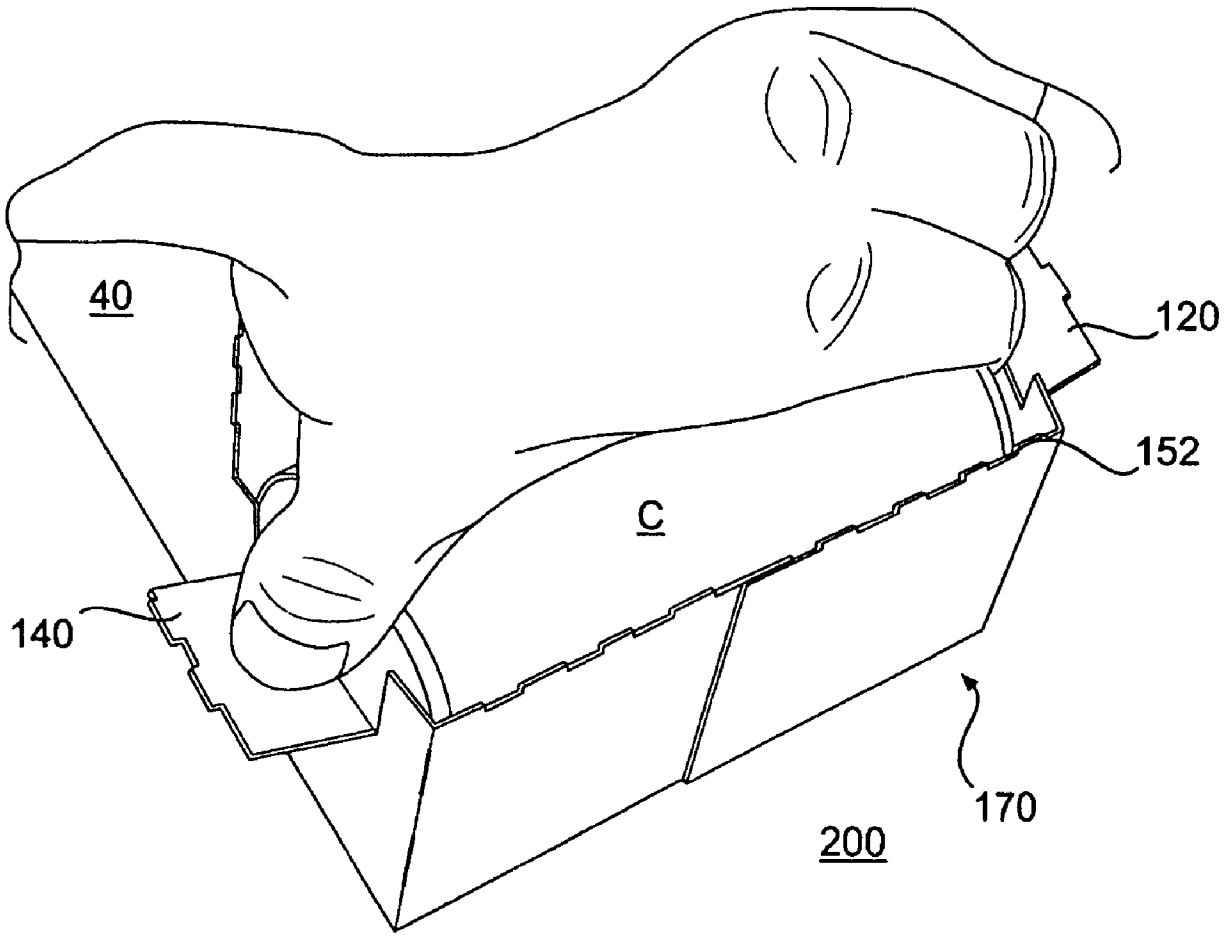

FIG. 8 is a partial side elevational view of the carton 200 with the dispenser 150 partially opened and removed from the carton, with the remaining containers C shown by hidden lines. A first container C has been removed from the carton 200 during opening of the dispenser 150. Referring to FIG. 9, the user may pivot the access flaps 120, 140 outwardly so that containers C in the bottom or lower column of containers adjacent to the exiting end panel 170 can be grasped and removed from the carton 200. The first and second access flaps 120, 140 need not be pivoted open immediately upon removing the removable section of the dispenser 150. For example, one or both of the access flaps 120, 140 may be opened after dispensing of the top column (or a middle column(s), if present) of containers C, or at any other time the consumer desires.

The height $H_1$ of the carton 200 may be, for example, a rough multiple of the diameter of the containers C in the carton, plus a small tolerance allowance. For example, the height $H_1$ can be approximately one, two, three, four, etc. times the container diameter D.

As shown in FIGS. 8 and 9, the height $H_2$ of an upper edge 152 of the dispenser opening may be sufficient to maintain the lower column of containers C in the carton 200, and may actually be larger than a diameter D of the containers C so that the upper column of containers is also retained in the carton 200 by the upper edge 152. In one embodiment, the height $H_2$ of the upper edge 152 of the opening formed by removing the dispenser 150 can be in the range of about 50%-150% of the container diameter D for a two column carton. For a three column carton, the height $H_2$ can be in the range of about 150%-250% of container diameter D.

The first and second access flaps 120, 140 may extend downwardly into the first and second side panels 20, 40 with a height $H_3$ that is sufficient to allow a user to grasp a container C in the bottom or lower column of containers when the access flaps 120, 140 are pivoted outwardly. The height $H_3$ of the access flaps 120, 140 may be generally described as any height that allows easy access to containers in the carton 200. In general, the height $H_3$ of the access flaps 120, 140 may be selected so that $H_2$-$H_3$ is less than the container diameter D, so that the access flaps 120, 140 allow access to a container C in the bottom column of containers.

The depth $D_1$ that the dispenser 150 extends into the carton 200 may be selected so that containers C in the upper columns of the carton can be accessed. For example, the depth $D_1$ can be in the range of about 70-130% of container diameter D.

EXAMPLE 1

A carton as illustrated in FIGS. 3A and 3B accommodates twelve 12 ounce beverage cans having a diameter D of about 2 and ½ in. The cans are arranged in two columns, six cans to each column (2×6 configuration). The carton has a height $H_1$ of about 5 and 7/32 in. and a width $W_1$ of about 4 and 27/32 in. The distance $D_1$ is about 2 and 19/32 in. The height $H_2$ of the upper edge 152 of the dispenser opening is about 2 and 23/32 in., and the height $H_3$ of the access flaps 120, 140 is about 1 and ¼ in.

The opening lines 110, 114, 130, 134 are cut/space lines and the lines 112, 132 are cut/crease lines. The access lines 122, 124, 142, 144 are cut lines and the lines 126, 146 are fold lines. The lines 116, 128, 136, 138 are offset cut/space lines.

FIGS. 10A-10F illustrate alternative access flap configurations that are suitable for inclusion in a dispenser pattern according to the present invention, such as the dispenser pattern 100 discussed above. In general, the access flaps can be of a configuration that enables the insertion of a user's fingers into the carton to enable an article to be removed therefrom.

Figure 10A:
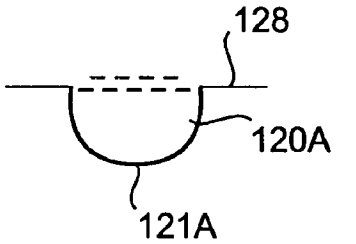
FIGS. 10A-10F illustrate alternative access flap configurations.

Referring specifically to FIG. 10A, the access flap 120A may be formed in a side panel of a carton, and may be situated similarly with respect to the line 128 as is the access flap 120 of the carton 200 shown in FIG. 8. The access flap 120A may be defined at its upper edge by the line 128, and along its lower perimeter by an access flap pattern 121A. The access flaps 120B-120F shown in FIGS. 10B-10F illustrate additional alternative flap forms that may also be arranged in a side panel as shown in FIG. 8, where like reference numerals may indicate like or similar elements to those of FIG. 10A.

Figure 11:
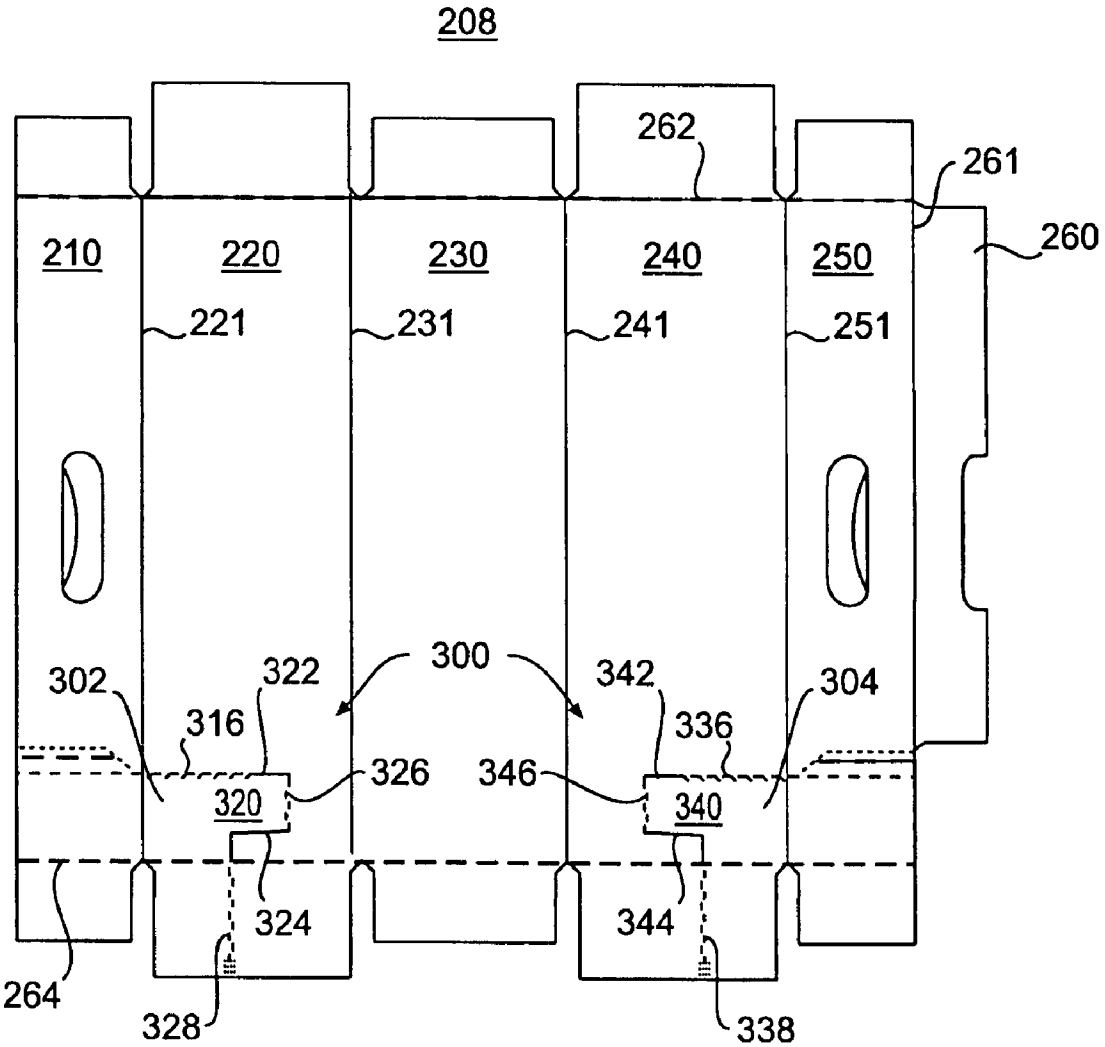
FIG. 11 is a plan view of a blank used to form a carton having a dispenser according to a second embodiment of the invention.

FIG. 11 is a plan view of a blank 208 used to form a carton 400 (illustrated in FIG. 12) having a dispenser 350 according to a second embodiment of the invention. In the carton 400, first and second access flaps 320, 340 are removed along with the dispenser 350 when the dispenser is opened. The carton 400 may, for example, be generally similar in shape, function and erection to the carton 200, and like reference numbers in the figures illustrating the two embodiments may indicate like or similar elements.

The blank 208 comprises a first top flap or panel 210 foldably connected to a first side panel 220 at a first fold line 221, a bottom panel 230 connected to the first side panel 220 at a second transverse fold line 231, a second side panel 240 foldably connected to the bottom panel 230 at a third transverse fold line 241, and a second top flap or panel 250 foldably connected to the second side panel 240 at a fourth transverse fold line 251. An adhesive flap 260 can be foldably connected to the second top flap 250 at a fifth transverse fold line 261.

Figure 12:
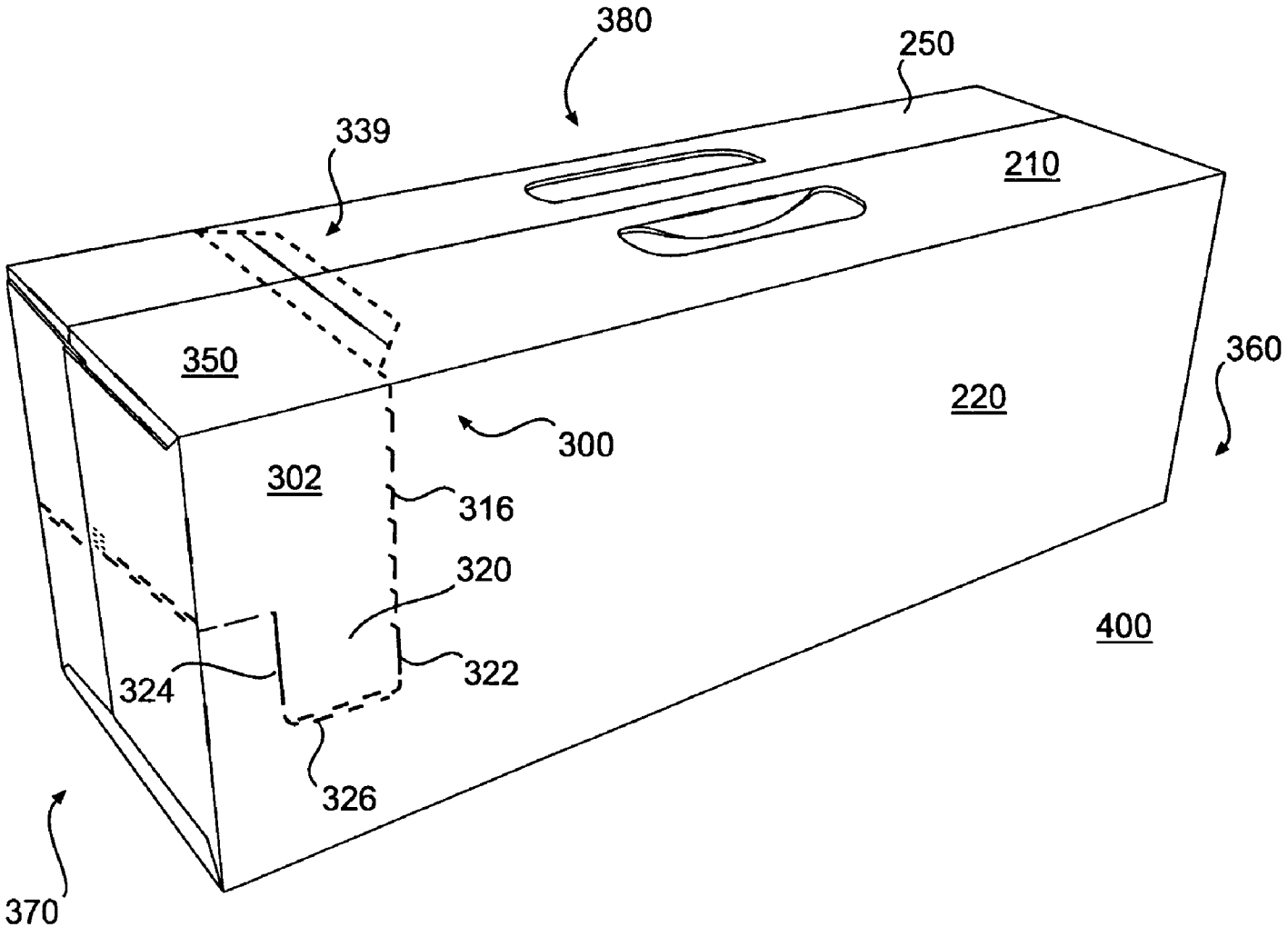
FIG. 12 is a perspective view of the erected carton according to the second embodiment.

The blank 208 includes a dispenser pattern 300 that defines the dispenser 350 in the erected carton 400 (shown in FIG. 12). The dispenser pattern 300 may comprise opening lines in the top flaps 210, 250 that define an opening pattern 339 that is similar in arrangement and operation to the opening pattern 139 of the carton 200 illustrated in FIG. 3A. The dispenser pattern 300 further comprises first and second generally downwardly or longitudinally extending lines 316, 336, and first and second generally laterally or horizontally extending lines 328, 338. The lines 316, 328 and the fold lines 221, 264 define in part a first side dispenser panel 302 in the first side panel 220, and the lines 336, 338 and the fold lines 251, 264 define in part a second side dispenser panel 304 in the second side panel 240.

A first access flap 320 is defined in part by first, second and third access lines 322, 324, 326, and a second access flap 340 is defined in part by fourth, fifth and sixth access lines 342, 344, 346. The first access flap 320 extends from a bottom portion of the first side dispenser panel 302, and the second access flap 340 extends from a bottom portion of the second side dispenser panel 304. As shown in FIG. 11, the first and second access flaps 320, 340 are continuous with the first and second side dispenser panels 302, 304, respectively, and are designed to be removed along with the dispenser 350 during opening.

The access lines 322, 324, 342, 344 may be, for example, cuts or tear lines formed from a series of cuts and/or scores. The lines 326, 346 may be, for example, tear lines formed from offset cut/space lines. The lines 316, 336 may be, for example, tear lines formed from spaced cuts. The lines 328, 338 may be tear lines formed from offset cut/space lines along a majority of their lengths. The lines 328, 338 may also include, for example, portions formed by cuts or scores and combinations thereof in order to facilitate opening of the dispenser 350. Other lines of disruption may be used to form the lines of the dispenser pattern 300 so that the dispenser 350 operates in accordance with the principles of the present invention.

FIG. 12 illustrates the erected carton 400. The carton 400 may enclose, for example, twelve 12 ounce containers C in an arrangement similar to the containers in the carton 200 (FIG. 3A). The carton 400 is closed at a first end by a first end panel 360, and at a second, exiting end by an exiting end panel 370. The top flaps 210, 250 form a top panel 380. Opening of the dispenser 350 is discussed below with reference to FIGS. 13 and 14.

Figure 13:
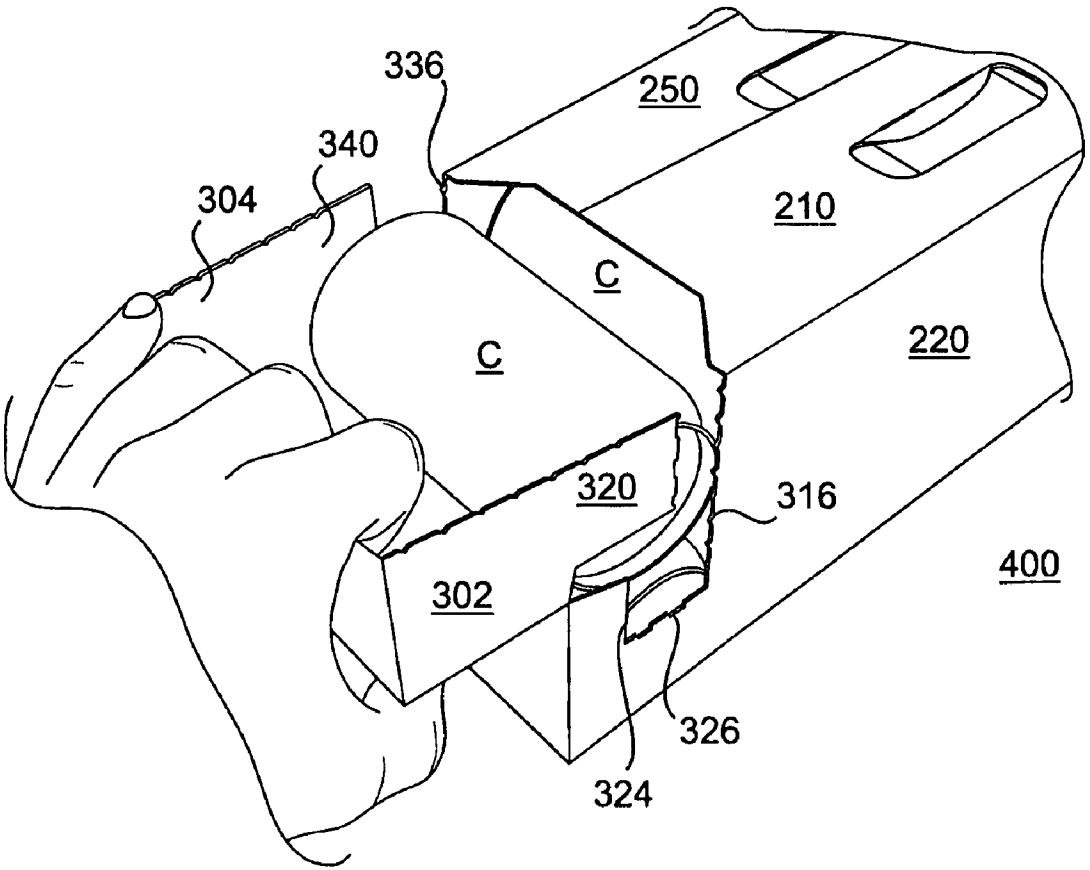
FIG. 13-14 illustrate opening of the carton dispenser according to the second embodiment.

FIG. 13 is a perspective view of the carton dispenser 350 being opened. Opening may be begun by pressing downwardly on the top panel 380 generally at the opening pattern 339 (shown in FIG. 12). The dispenser 350 is further opened by tearing along the lines 316, 326, 328, 336, 346, 338 so that the dispenser 350 may be pivoted open and tom off of the carton 400. One or more of the tear lines in the dispenser pattern 300 may include portions interspersed with cuts, gaps and/or scores etc. to facilitate opening of the dispenser 350.

Figure 14:
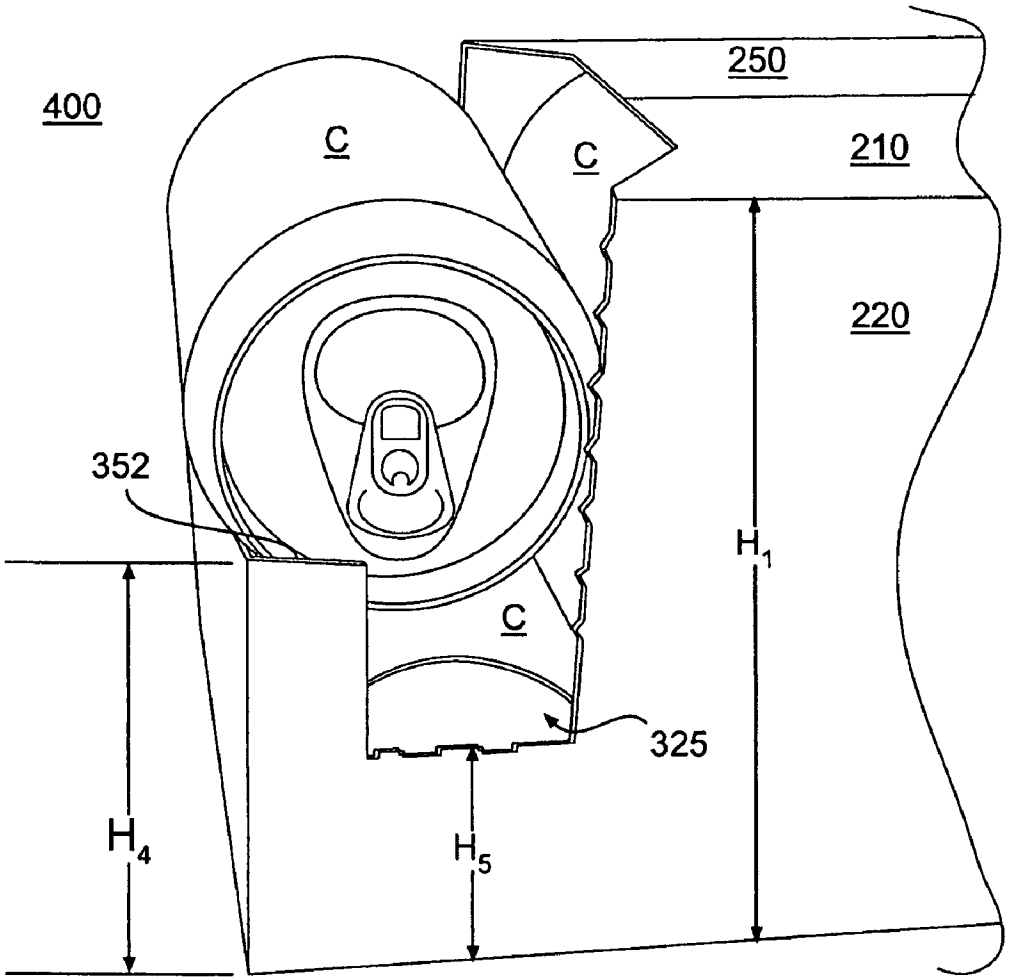

FIG. 14 is a perspective view of the carton 400 with the dispenser 350 opened and removed from the carton. If the containers C are stacked in multiple columns in the carton 400, a container C adjacent to the dispenser 350 may remain in place as shown in FIG. 14, or, the container may be carried out of the carton 400 as generally shown in FIG. 7. Removal of the access flaps 320, 340 creates a first access opening 325 in the first side panel 220 and a second access opening in the second side panel (not shown in FIG. 14) that allow easy access to a lower column of containers C, regardless of the height of the upper edge 352 of the dispenser opening.

The height $H_1$ of the carton 400 may be, for example, a rough multiple of the diameter of the containers C in the carton, plus a small tolerance allowance. For example, the height $H_1$ can be approximately one, two, three, four, etc. times the container diameter D.

The height $H_4$ of an upper edge 352 of the dispenser opening may be sufficient to maintain both the upper and lower columns (and a middle column(s), if present) of containers C in the carton 400, and, as illustrated in FIG. 14, the upper edge 352 may be higher than a diameter D of the containers C in FIG. 14. In one embodiment, the height $H_4$ of the upper edge 352 of the opening formed by removing the dispenser 150 can be in the range of about 50%-150% of the container diameter D for a two column carton. For a three column carton, the height $H_4$ can be in the range of about 150%-250% of the container diameter D.

The height $H_5$ of the bottom of the access openings may be of any height to allow easy access to containers in the carton 400, and the bottom of the access openings may be extended downwardly to a point adjacent to the bottom panel of the carton 400. In general, the height $H_5$ of the bottom of the access openings can be less than the container diameter D so that the access openings allow access to a container C in the bottom column of containers.

Figure 15:
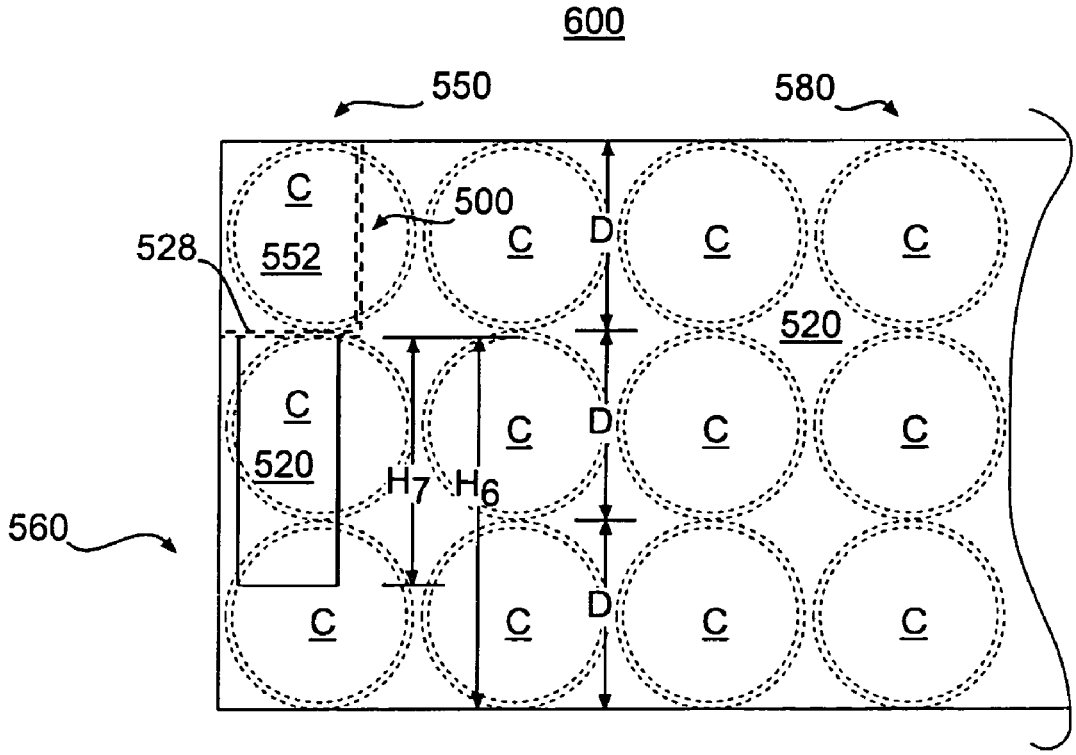
FIG. 15 is a partial side elevational view of a carton having a dispenser according to a third embodiment of the invention.

FIG. 15 is a partial side elevational view of a carton 600 according to a third embodiment of the invention. The carton 600 can be generally similar to the cartons 200, 400 discussed above, and like reference numbers in the cartons 200, 400 may indicate like or similar elements in FIG. 15. The carton 600, however, is designed to accommodate three columns of containers C. The carton 600 may, for example, be designed to accommodate any number of rows and columns of containers C. The height of the carton 600 is illustrated as generally corresponding to three times a container diameter D so that it may accommodate the three columns of cylindrical containers C.

The carton 600 has a dispenser 550 defined by a dispenser pattern 500. A first side dispenser panel 552 may be defined in a first side panel 520, and may have a first access flap 520 extending from a bottom portion thereof. The first access flap 520 may be separated from the first side dispenser panel 552 by a tear line 528, and may be pivotable in a manner similar to the access flaps 120, 140 (FIG. 9). The access flap 520 may have a height $H_7$ extending down into the first side panel 520 that allows containers in both a middle column and a bottommost column of the carton 600 to be accessed when the dispenser 550 is opened. In general, the height $H_7$ may be selected so that $H_6$-$H_7$ is less than the container diameter D so that the access openings allow access to a container C in the bottom column of containers. The height $H_6$ of the tear line 528 may be, for example, greater than about twice the container diameter D so that the edge of the dispenser opening (defined by the tear line 528) retains the uppermost column of containers C when the dispenser 550 is opened. A second access flap (not shown) may be formed in a second side panel of the carton 600.

Figure 16:
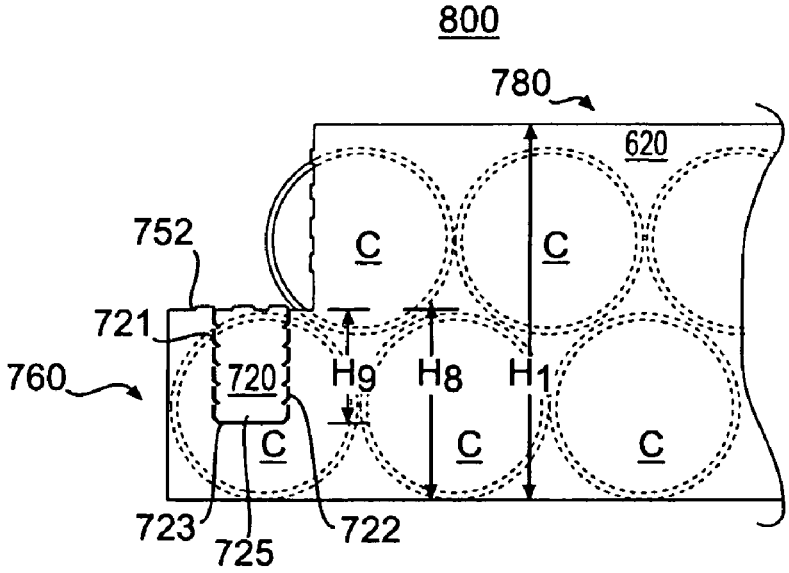
FIG. 16 is a partial side elevational view of a carton having a dispenser according to a fourth embodiment of the invention.

FIG. 16 is a partial side elevational view of a carton 800 according to a fourth embodiment of the invention. The carton 800 is illustrated with its dispenser flap removed. The carton 800 can be generally similar to the cartons 200, 400 discussed above, and like reference numerals in the cartons 200, 400 may indicate like or similar elements in FIG. 16.

The dispenser of the carton 800 may be substantially identical to the dispenser 150 in the carton 200 (FIG. 3A). The first access flap 720, however, is not pivotably attached to the first side panel 720. Instead, the first access flap 720 may have the form of a tear strip defined by spaced tear lines 721, 722 and a cut 723 that defines a tear tab 725. The height $H_8$ of the upper edge 752 of the opening formed by removing the dispenser can be in the range of about 50%-150% of container diameter D for a two column carton. The height $H_9$ of the access flap 720 may be of any height to allow easy access to containers in the carton 800. A second access flap may be formed in a second side panel (not shown) of the carton 800.

Figure 10B:
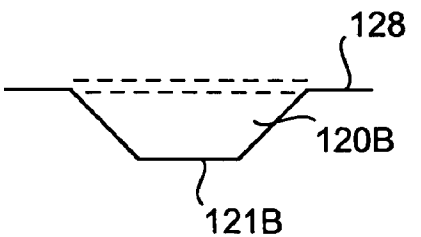
Figure 10C:
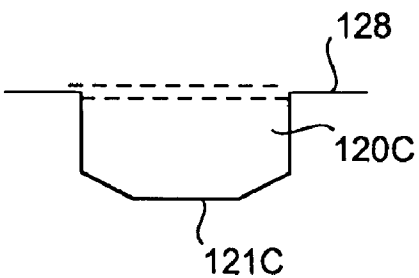
Figure 10D:
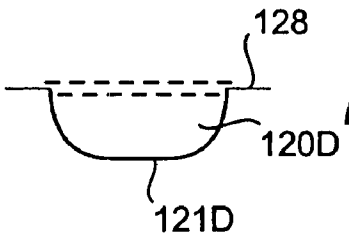
Figure 10E:
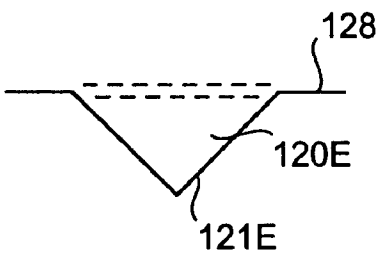
Figure 10F:
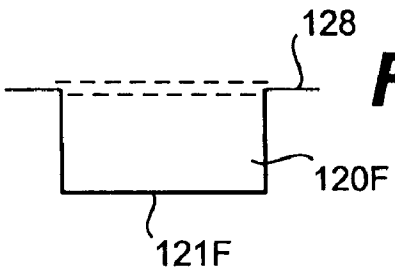

The alternative flap forms shown in FIGS. 10A-10B may be defined at their top or upper edges by tear lines 128, as shown in the figures, or, they may be continuous with the remainder of a side dispenser panel, as generally shown in the embodiment of FIG. 12. If the access flaps 120B-120F are continuous with the remainder of their respective dispensers, there may be no tear lines 128 at the upper edges of the access flaps, and the access flaps may be removed when the dispenser is opened.

The access flaps described above are illustrated as extending from a lower portion of side dispenser panels, and allow containers and other articles to be accessed from the sides of cartons. Access flaps according to the present invention can also be formed in other panels of cartons. For example, referring to FIG. 3A, an access flap could be formed to extend downwardly from either of the lines 128, 138, so that a consumer could access a container in the bottom column through the exiting end panel. Such an access flap could be either pivotably attached to the exiting end panel, or continuous with the dispenser such that it is removed along with the dispenser.

For purposes of illustration, the present invention is disclosed in the context of paperboard cartons sized and dimensioned to contain cylindrical beverage cans. The cartons illustrated in the drawing figures are sized to accommodate articles in a two or three column configuration, although the present invention is not limited to any specific size or dimension. For example, the present invention would work satisfactorily if sized and shaped to hold articles in alternative arrangements, such as 3×4, 4×3, 2×4, 2×5, 4×6, 4×5, 3×6, 5×6, etc. The present invention can also be used in cartons that include various features, including additional opening features that provide easy access to the articles, and tilt features that position the articles at the front end of the carton.

Also for purposes of illustration, the embodiments of the present invention are shown with dispensers primarily formed by non-oblique dispenser lines that are shown as generally perpendicular to some panels and parallel to other panels. However, the present invention is not limited to any specific size, dimension, orientation of the dispenser, or opening formed by the dispenser. For example, the present invention would operate satisfactorily if the dispenser is formed with oblique lines that extend through the side and/or top panels.

The access flaps discussed herein can extend from the dispenser opening to the bottom of the carton. Additionally, the access flaps can be of any width and at any position along the panels of the carton. For example, the access flaps can be formed to intersect, abut, or otherwise be adjacent to the exiting end panels at the dispensing ends of the cartons. Further, the access flaps can be formed as an extension of the dispenser opening perforations, and can be formed as a portion extending deeper into the side panels behind the dispenser perforations.

The pivotable flaps discussed above can remain attached to the cartons and provide the access openings when desired by a user, while being hingedly returnable to fill all or part of the access openings. Accordingly, the flaps can return to their original positions in order to occlude the access openings, and can subsequently be hingedly opened to dispense subsequent articles.

The access flaps of the present invention can be comprised of individual and/or separate segments or extensions that can be removed at a later time to provide a deeper access opening to more easily reach articles in cartons of larger dimension. For example, any of the access flaps described in the present specification can include a first section and a second section, wherein the first and second sections are removeable or pivotable at different times.

The blanks according to the present invention can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blanks. The blanks may also be coated with, for example, a moisture barrier column, on either or both sides of the blanks. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the dispensers to function at least generally as described above. The blanks can also be laminated to or coated with one or more sheet-like materials at selected panels or panel sections.

In accordance with the above-described embodiments of the present invention, a fold line can be any substantially linear, although not necessarily straight, form of weakening that facilitates folding therealong. More specifically, but not for the purpose of narrowing the scope of the present invention, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line or other line of disruption.

The above embodiments may be described as having one or panels adhered together by glue during erection of the carton embodiments. The term "glue" is intended to encompass all manner of adhesives commonly used to secure carton panels in place.

The foregoing description of the invention illustrates and describes the present invention. Additionally, the disclosure shows and describes only selected embodiments of the invention, but it is to be understood that the invention is capable of use in various other combinations, modifications, and environments and is capable of changes or modifications within the scope of the inventive concept as expressed herein, commensurate with the above teachings, and/or within the skill or knowledge of the relevant art.

What is claimed is:

1. A blank for forming a carton, comprising:

a first side panel;

at least one top panel;

a second side panel;

a bottom panel;

at least one first end flap extending along a first marginal area of the blank, the at least one first end flap comprising a first side end flap being foldably connected to the first side panel at an end flap fold line;

at least one second end flap extending along a second marginal area of the blank;

a dispenser pattern extending through at least the top panel, the first side end flap, and the first side panel, wherein the dispenser pattern defines a first side dispenser panel in the first side panel and an access flap adjacent to the first side dispenser panel, and wherein the access flap is at least partially defined by at least one access flap line in the first side panel extending away from the first side dispenser panel in a direction that is substantially parallel to the end flap fold line, and the access flap is spaced apart from the end flap fold line and remains connected to the side panel upon removal of the first side dispenser panel.

2. The blank of claim 1, wherein the blank comprises a length in a longitudinal direction and a width in a lateral direction, and the dispenser pattern comprises a first lateral line extending through the first side panel generally in the lateral direction and substantially perpendicular to the end flap fold line.

3. The blank of claim 2, wherein the access flap is defined at least in part by the first lateral line.

4. The blank of claim 3, wherein the first lateral line is a tear line and the at least one access flap line comprises two longitudinal access lines extending from the first lateral line and a lateral fold line extending between the two longitudinal access lines.

5. The blank of claim 3, wherein the dispenser pattern comprises a first longitudinal line extending through the first side panel.

6. The blank of claim 5, wherein the first longitudinal line has an end in the first side panel adjacent to an end of the first lateral line.

7. The blank of claim 3, wherein the access flap is a first access flap and the dispenser pattern further defines a second access flap and a second side dispenser panel in the second side panel, the second access flap being adjacent to a second lateral line of the dispenser pattern extending through the second side panel and being spaced apart from the fold line.

8. The blank of claim 3, wherein the dispenser pattern comprises a plurality of opening lines in the at least one top panel.

9. In combination, a substantially parallelepipedal carton formed from the blank of claim 1 and a plurality of articles enclosed within the carton.

10. The blank of claim 1:

wherein a portion of the first side panel is positioned between the access flap and the at least one fold line.

11. A blank for forming a carton, comprising:

a first side panel;

at least one top panel;

a second side panel;

a bottom panel;

at least one first end flap extending along a first longitudinal marginal area of the blank, wherein the blank comprises a longitudinal direction extending lengthwise of the blank and a lateral direction extending widthwise of the blank, and wherein the at least one first end flap comprises a first side end flap connected to the first side panel at a longitudinal end flap fold line;

at least one second end flap extending along a second marginal area of the blank; and a dispenser pattern extending at least through the top panel and the first side panel and defining a first side dispenser panel and an access flap extending from a bottom portion of the first side dispenser panel, wherein the access flap is spaced apart from the end flap fold line, the dispenser pattern comprising:

a first lateral line defining an upper edge of the access flap and a lower edge of the first side dispenser panel and extending through the first side panel;

at least one access flap line extending from the first lateral line away from the first side dispenser panel in the longitudinal direction and at least partially defining the access flap in the first side panel; and a first longitudinal line extending through the first side panel, wherein the first longitudinal line intersects the first lateral line in the first side panel.

12. The blank of claim 11, wherein the at least one access flap line is a first access flap line, the dispenser pattern further comprises a second access flap line extending from the first lateral line in the longitudinal direction, and a lateral fold line extending between the first access flap line and the second access flap line and foldably connecting the first access flap to the first side panel, the first access flap line and the second access flap line each comprise at least one of a tear line or a cut line.

13. The blank of claim 11, wherein the access flap is a first access flap and the blank further comprising a second side dispenser panel and second access flap extending from a bottom portion of the second side dispenser panel, the second access flap being adjacent to a second lateral line of the dispenser pattern extending through the second side panel.

14. The blank of claim 13, wherein the dispenser pattern comprises a plurality of opening lines in the top panel.

15. A carton, comprising:

a first side panel;

a top panel;

a second side panel;

a bottom panel;

an end flap foldably connected to the first side panel at an end flap fold line, the end flap forming an exiting end panel; and a dispenser defined at least in part by a dispenser pattern extending through the top panel, the first side panel, and the exiting end panel, wherein the dispenser comprises a first side dispenser panel and an access flap in the first side panel, the first side dispenser panel comprising a dispenser line extending in the first side panel from the end flap fold line in a first direction that is substantially perpendicular to the end flap fold line, the first access flap is at least partially defined by at least one access flap line in the first side panel extending away from the first side dispenser panel in a second direction that is substantially parallel to the end flap fold line, and the first access flap being spaced apart from the end flap fold line.

16. The carton of claim 15, wherein the dispenser line is a tear line and the access flap is further defined by first and second access flap lines extending from the dispenser line and being generally perpendicular to the dispenser line, and a third access flap line extending between the first and second access flap lines, each of the first, second, and third access flap lines comprising at least one of a tear line or a cut line.

17. The carton of claim 16, wherein the dispenser pattern comprises a first generally downwardly extending line extending through the first side panel generally along a height of the carton, the first downwardly extending line is parallel to the end flap fold line and has an end in the first side panel adjacent to an end of the dispenser line.

18. The carton of claim 17, wherein the first side panel comprises a first height, the dispenser line forms an upper edge of a dispenser opening that is located in the first side panel at a second height in the first side panel that is less than the first height, the third access flap line extending between the first and second access flap lines being located at a third height in the first side panel that is less than the first height and the second height.

19. The carton of claim 18 in combination with a plurality of containers, the containers having a diameter, the third height being less than the diameter of the containers.

20. The carton of claim 15, wherein the access flap is a first access flap and the dispenser further comprises a second side dispenser panel and a second access flap in the second side panel, the second access flap extending from a bottom portion of the second side dispenser panel, and being spaced apart from the fold line.

21. The carton of claim 15, wherein the dispenser pattern comprises a plurality of opening lines in the top panel.

22. The carton of claim 15, wherein the access flap is removably connected to the first side dispenser panel by a tear line.

23. The carton of claim 15, wherein the access flap is defined at a bottom edge and is foldably connected to the first side panel by a fold line in the first side panel, the fold line in the first side panel allowing the access flap to be foldably positioned relative to the first side panel.

24. The carton of claim 15, wherein the access flap is continuous with the first side dispenser panel.

25. The carton of claim 15, wherein the access flap is a tear strip.

26. The carton of claim 15, wherein the carton is substantially parallelepipedal.

27. In combination, a carton according to claim 15 and a plurality of articles within the carton.

* * * * *